US008132776B2

(12) United States Patent
Sladojevic

(10) Patent No.: US 8,132,776 B2
(45) Date of Patent: Mar. 13, 2012

(54) SIDEFORM SYSTEM

(75) Inventor: Robert Sladojevic, Kent Town (AU)

(73) Assignee: SRB Construction Technologies Pty. Ltd., South Australia (AU)

( * ) Notice: Subject to any disclaimer, the term of this patent is extended or adjusted under 35 U.S.C. 154(b) by 98 days.

(21) Appl. No.: 12/514,394

(22) PCT Filed: Oct. 31, 2007

(86) PCT No.: PCT/AU2007/001652

§ 371 (c)(1),
(2), (4) Date: Feb. 2, 2010

(87) PCT Pub. No.: WO2008/058310

PCT Pub. Date: May 22, 2008

(65) Prior Publication Data

US 2010/0133416 A1 Jun. 3, 2010

(30) Foreign Application Priority Data

Nov. 14, 2006 (AU) ..... 2006906337

(51) Int. Cl.
*B28B 7/00* (2006.01)
*B22D 19/00* (2006.01)
*E04G 9/00* (2006.01)

(52) U.S. Cl. ..... 249/139; 249/93; 249/134; 249/163; 249/189; 249/205; 52/127.3; 52/127.6

(58) Field of Classification Search ..... 249/93, 249/120, 134, 135, 139, 163, 187.1, 189, 249/193, 205; 52/127.2, 127.3, 127.6, 655.1; 403/255, 292

See application file for complete search history.

(56) References Cited

U.S. PATENT DOCUMENTS

| | | | | |
|---|---|---|---|---|
| 1,939,007 | A | 12/1933 | Heltzel | |
| 2,508,032 | A * | 5/1950 | Kennedy | 52/847 |
| 5,015,117 | A * | 5/1991 | Pawlicki | 403/300 |
| 5,203,135 | A * | 4/1993 | Bastian | 52/848 |
| 5,205,942 | A * | 4/1993 | Fitzgerald | 249/3 |
| 5,927,041 | A * | 7/1999 | Sedlmeier et al. | 52/836 |
| 5,970,679 | A * | 10/1999 | Amore | 52/846 |
| 6,247,677 | B1 * | 6/2001 | Vinet et al. | 249/189 |
| 6,397,551 | B1 * | 6/2002 | Lewcock et al. | 52/655.1 |
| 7,014,213 | B1 * | 3/2006 | Kaiser | 285/125.1 |
| 7,152,378 | B2 * | 12/2006 | Takagi et al. | 52/381 |
| 7,303,361 | B1 * | 12/2007 | Lane | 405/287 |
| 7,578,110 | B2 * | 8/2009 | Jenkins | 52/655.1 |
| 2005/0061948 | A1 * | 3/2005 | Brennan | 249/167 |
| 2006/0180802 | A1 * | 8/2006 | Forbis | 256/24 |

(Continued)

FOREIGN PATENT DOCUMENTS

WO 01-44600 A1 6/2001

(Continued)

*Primary Examiner* — Joseph Del Sole
*Assistant Examiner* — Dimple Bodawala
(74) *Attorney, Agent, or Firm* — Sughrue Mion, PLLC

(57) ABSTRACT

A sideform (10) for a sideform system includes an elongate body member (12) defining a side forming face (14) and an opposed mounting portion (16) for mounting the body member on a sideform holder. At least one recessed region (18, 20), in which an insert is receivable, is defined in the body member (12). An engaging arrangement (22) is associated with the recessed region (18, 20) for securing the insert in position in the recessed region (18, 20). At least one attaching formation (28) is arranged on the body member (12) in association with the side forming face (14) for attaching an edge form.

16 Claims, 6 Drawing Sheets

U.S. PATENT DOCUMENTS

2006/0239781 A1* 10/2006 Kliefoth et al. ..... 405/229
2007/0278378 A1* 12/2007 Sullivan ..... 249/187.1
2007/0284506 A1* 12/2007 Benedict ..... 249/190
2008/0265127 A1* 10/2008 Sladojevic et al. ..... 249/189
2009/0295055 A1* 12/2009 Sladojevic et al. ..... 269/86
2010/0155571 A1* 6/2010 Sladojevic et al. ..... 249/187.1

FOREIGN PATENT DOCUMENTS

WO WO 03052218 A1 * 6/2003
WO 2005-116365 A1 12/2005

* cited by examiner

SIDEFORM SYSTEM

CROSS-REFERENCE TO RELATED APPLICATIONS

This application is a national phase application under 35 U.S.C. §371 of International Patent Application No. PCT/AU2007/001652 filed on Nov. 14, 2007 which claims the benefit of Australian Provisional Patent Application No 2006906337 filed on Nov. 14, 2006, the disclosures of which are incorporated herein by reference in their entirety.

FIELD OF THE INVENTION

This invention relates to a sideform system suitable for forming concrete structural elements, in particular, concrete panels/slabs. More particularly, the invention relates to a sideform for a sideform system and to a sideform system including the sideform. The invention has particular, but not necessarily exclusive, application to a sideform system for tilt up concrete panels/slabs for the construction of buildings.

BACKGROUND TO THE INVENTION

As each panel or slab of a tilt up building system is moulded, it is desirable to form, along opposed edges of the panel or slab, suitable complementary shapes for mating with adjacent panels or slabs or to form sides of particular shapes for decorative or functional purposes. Having a large number of different sideforms can be expensive and a simplified inventory has the benefit of reduced costs and storage issues.

A panel/slab is defined as having a pair of opposed surfaces or faces and the sides of the panel extend between the surfaces. Where a side meets a surface, an edge is formed.

SUMMARY OF THE INVENTION

According to a first aspect of the invention, there is provided a sideform for a sideform system, the sideform including an elongate body member defining a side forming face and an opposed mounting portion for mounting the body member on a sideform holder;

at least one recessed region, in which an insert is receivable, defined in at least the side forming face of the body member;

an engaging arrangement associated with the recessed region for securing the insert in position in the recessed region; and at least one attaching formation arranged on the body member in association with the side forming face for attaching an edge form.

The body member may have a pair of spaced hollow structures interconnected by a web, facing portions of the hollow structures and the web defining the at least one recessed region. The engaging arrangement may comprise an undercut part of each facing portion of the hollow structures for clipping engagement with the insert.

Preferably, the web is centrally located relative to the hollow structures to define a first recessed region in the side forming face and a second recessed region, on an opposed side of the web, in the mounting portion of the body member.

At least one aperture may be defined in the web to permit the passage of a constructional element, such as, for example, a reinforcing bar or ducting, through the body member.

The sideform may include a pair of attaching formations, the attaching formations being arranged on opposed sides of the recessed region in the side forming face. Each attaching formation may be a clip for removably attaching an edge form of a resiliently flexible material.

The body member may be an extrusion of an aluminium or a plastics material.

According to a second aspect of the invention, there is provided a sideform system which includes a sideform as described above; and at least one insert removably received in the at least one recessed region of the body member of the sideform to define, together with the side forming face of the body member, a predetermined profile to be imparted to a side of a concrete structural element.

The system may include a plurality of inserts of different cross-sectional shapes to enable different profiles to be imparted to the side of the structural element. The structural element may be a concrete wall panel or a concrete floor slab. Each insert may be of a resiliently flexible material.

At least some of the inserts may have apertures through them through which constructional elements can pass.

At least one insert may carry protrusions on its operatively outer surface, the protrusions, in use, being moulded into the structural element to attach the insert to the structural element to be retained on the structural element when the body member is removed, the insert then forming a sealing strip of the structural element.

The system may include at least one edge form. Preferably, the system includes a plurality of edge forms of different cross-sectional shapes, each edge form being releasably attachable to the attaching formation of the body member of the sideform to impart a desired edge profile to the structural element being formed. Each edge form may have a rounded profile to impart a rounded convex or concave shape to the edge of the structural element. It will be appreciated, however, that each edge profile could have other profiles, for example, stepped, bevelled, or the like. Each edge form may be of a resiliently flexible material.

BRIEF DESCRIPTION OF THE DRAWINGS

The invention; p['l is now described by way of example with reference to the accompanying drawings in which:—

DETAILED DESCRIPTION OF EXEMPLARY EMBODIMENTS

Figure 2:
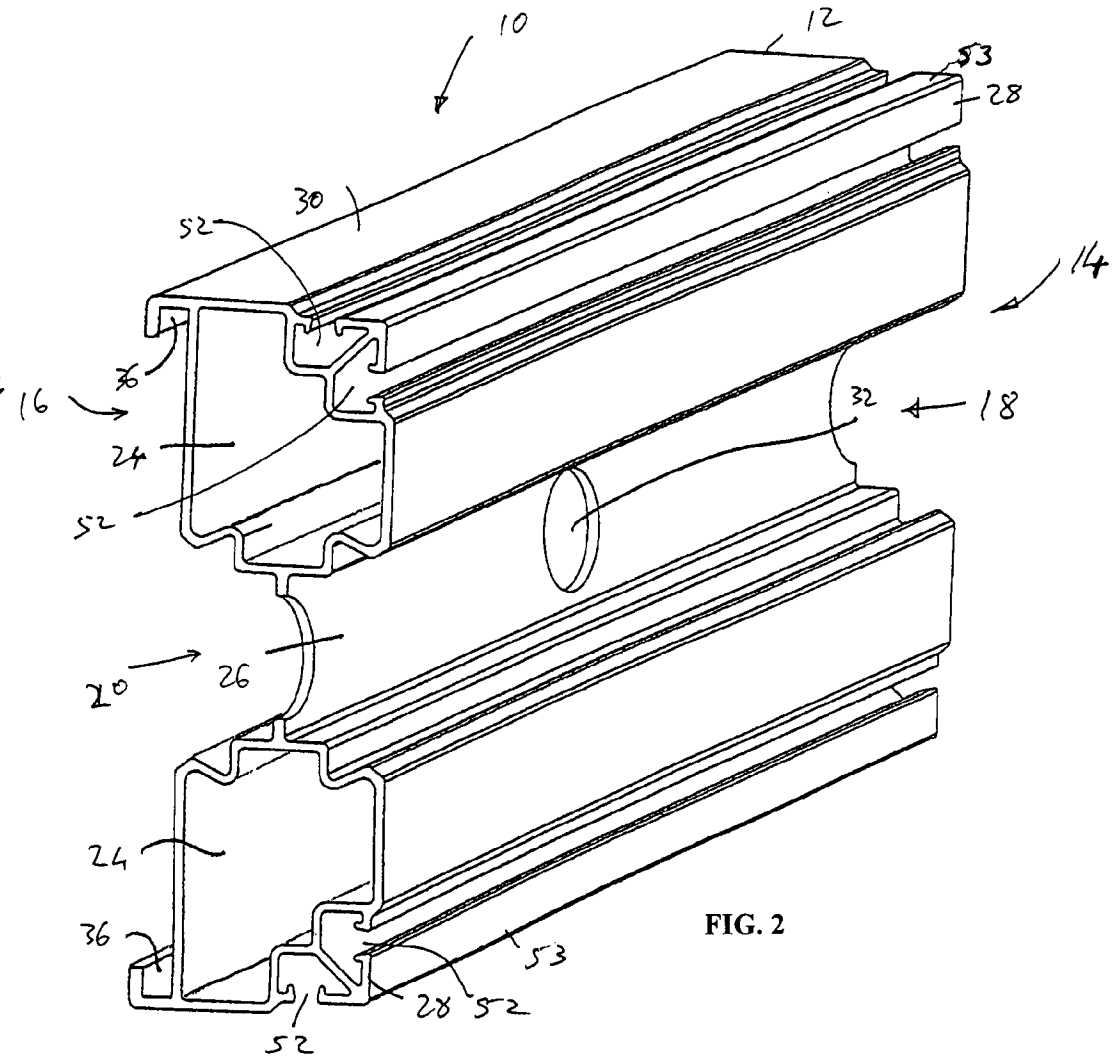
FIG. 2 shows an isometric view of the sideform.
Figure 1:
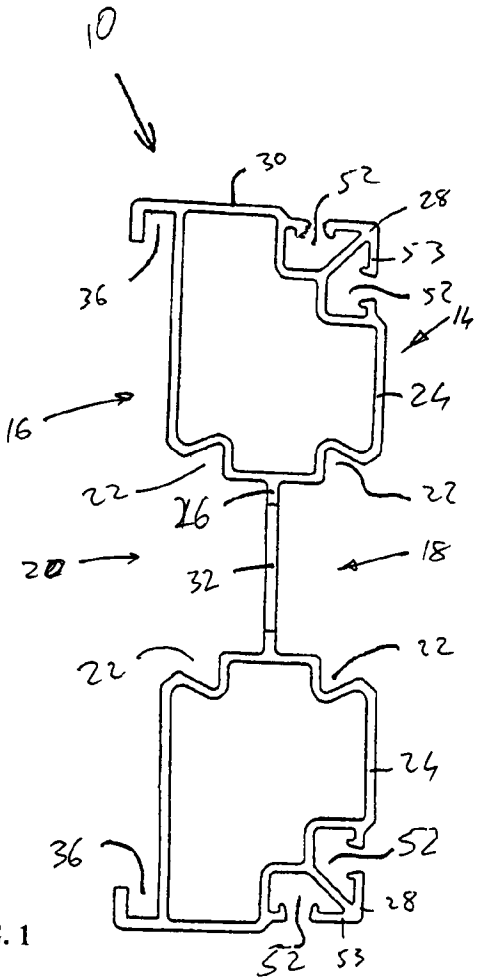
FIG. 1 shows an end view of an embodiment of a sideform of a sideform system.

In FIGS. 1 and 2 of the drawings, reference numeral 10 generally designates an embodiment of a sideform for a sideform system. The sideform 10 includes an elongate body member 12 defining a side forming face 14 and an opposed mounting portion 16 for mounting the body member 12 on a sideform holder (not shown). A pair of opposed recessed regions 18 and 20 is defined in the side forming face 14 and the mounting portion 16, respectively. In addition, an engaging arrangement in the form of a pair of opposed undercuts 22, as will be described in greater detail below, is arranged in the body member 12, in association with the side forming face 14 for attaching an edge form.

The body member 12 is an extrusion. The extrusion is, preferably, of an aluminium material but could be of a suitable synthetic plastics material. The extruded body member 12 comprises a pair of spaced hollow, box-like sections 24 interconnected by a web 26. The web 26 is substantially centrally located with respect to the box-like sections 24 to define the recessed regions 18 and 20. The box-like sections 24 define the undercuts 22 for securing the insert in position in the relevant recessed region 18, 20.

The body member 12 further defines an attaching formation in the form of a clip 28, on the side forming face 14 of the body member 12. Each clip 28 is configured to receive an edge form over it, as will be described in greater detail below, for attaching the edge form to the body member 12.

The body member 12 also defines a planar upper surface 30. The planar upper surface 30 permits the passage of concrete levelling equipment over the top of the sideform 10, in use.

As illustrated in FIGS. 1 and 2 of the drawings, the web 26 has a plurality of apertures 32 defined at intervals along the length of the web 26. The apertures 32 permit the passage of constructional elements, such as reinforcing bars 34 (FIG. 7) or ducting (not shown), through the web 26 of the sideform 10 to be at least partially embedded in a concrete panel being cast using the sideform 10

The mounting portion 16 of the sideform 10 carries a pair of opposed, facing channel shaped hook formations 36 for mounting the sideform 10 on a sideform holder (not shown).

Figure 3:
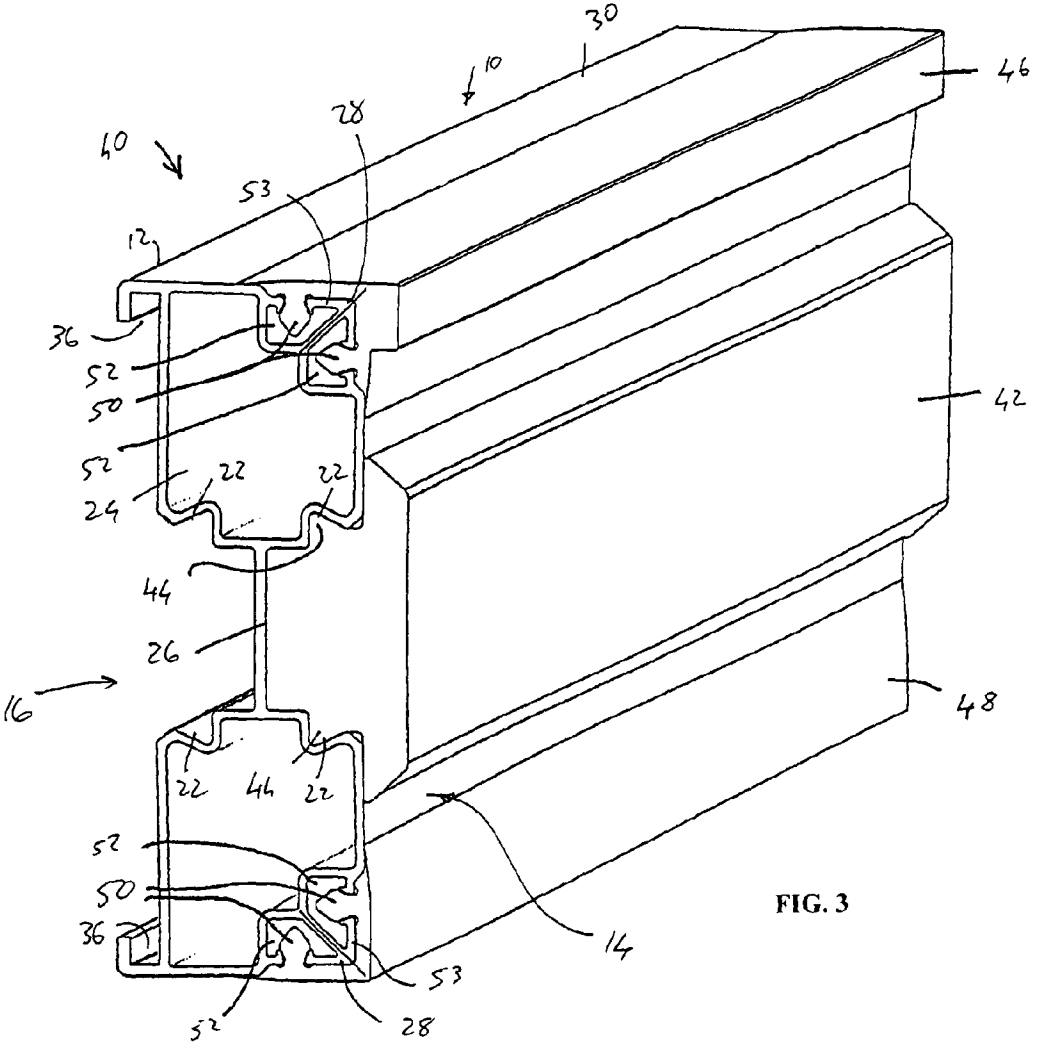
FIG. 3 shows an isometric view of a first embodiment of a sideform system.

Referring now to FIG. 3 of the drawings, an embodiment of a sideform system is illustrated and is designated generally by the reference numeral 40. The system 40 includes the sideform 10. An insert 42 of a resiliently flexible material is received in the recessed region 18. The insert 42 has a pair of opposed ribs 44. Each rib 44 is received in one of the undercuts 22 associated with the recessed region 18. The insert 42 is, preferably, of an elastomeric material such as a suitable rubber material.

Further, in the embodiment illustrated in FIG. 3 of the drawings, the system 40 includes an upper edge form 46 for imparting a predetermined shape to an upper, perimetral edge of a concrete panel being moulded. The system 40 also includes a lower edge form 48 for imparting a predetermined shape to a lower, perimetral edge of the panel being moulded. In the illustrated embodiment, the upper edge form 46 imparts a stepped shape to the upper perimetral edge of the panel while the lower edge form imparts a substantially straight edge to the lower perimetral edge of the panel being moulded. Word denoting direction are to be understood with reference to the panel/slab in its orientation in which it is moulded, i.e. lying horizontally. In addition, reference to a side of the panel/slab is a reference to that part of the panel/slab extending between opposed faces or surfaces of the panel/slab and a reference to a perimetral edge of the panel/slab is to the part of the panel/slab at a junction between the side and one of the surfaces of the panel/slab Each edge form 46, 48 is, like the insert 42, of a resiliently flexible material, more particularly, an elastomeric material such as a suitable rubber material. Each edge form 46, 48, on a rear surface, includes a pair of orthogonally arranged clips 50. The clips 50 are received in channels 52 defined behind a barbed formation 53 of the clip 28 of the body member 12.

It is to be noted that the shape of the insert 42 imparts a dove tail recess in a panel to be moulded using the sideform 10. The insert 42 could be shaped to impart a mating tongue to the side of the panel so that dove-tail joints or tongue and groove joints can be formed.

Figure 4:
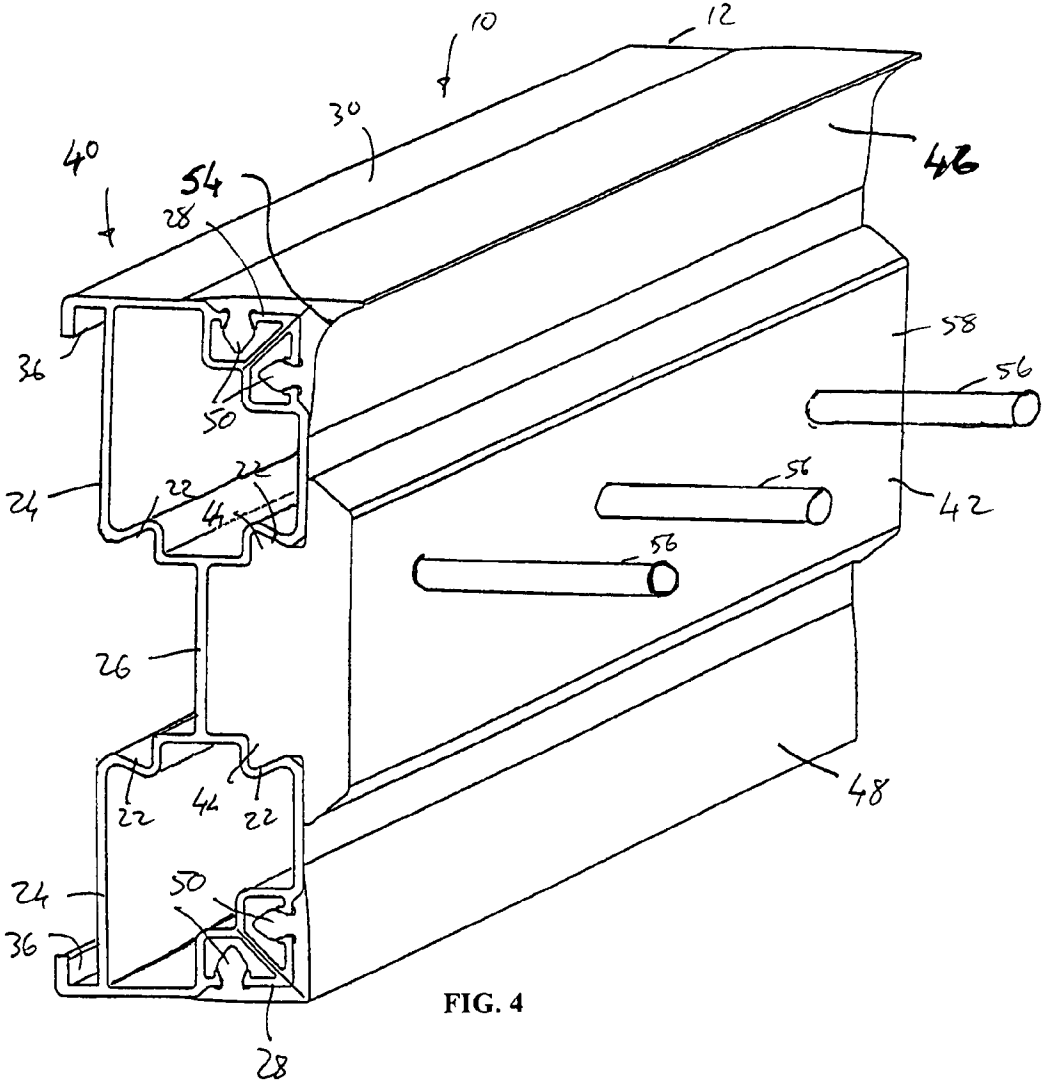
FIG. 4 shows an isometric view of a second embodiment of a sideform system.

In the embodiment illustrated in FIG. 4 of the drawings, a further embodiment of a sideform system 40 is illustrated. With reference to FIG. 3, like reference numerals refer to like parts unless otherwise specified. In this embodiment, the upper edge form 46 has a concave moulding surface 54. This, in turn, imparts a convex edge to the panel being molded. Conversely, the upper edge form 46 and/or the lower edge form 48 could have a convex moulding surface to impart a concave edge to the panel being moulded.

It is also to be noted, in this embodiment, that the insert 42 carries protrusions 56 on its moulding surface 58. These protrusions are embedded, in use, in the concrete panel being moulded so that, when the sideform 10 is removed, the insert 42 remains attached to the side of the panel to form a sealing strip of the panel.

Figure 5:
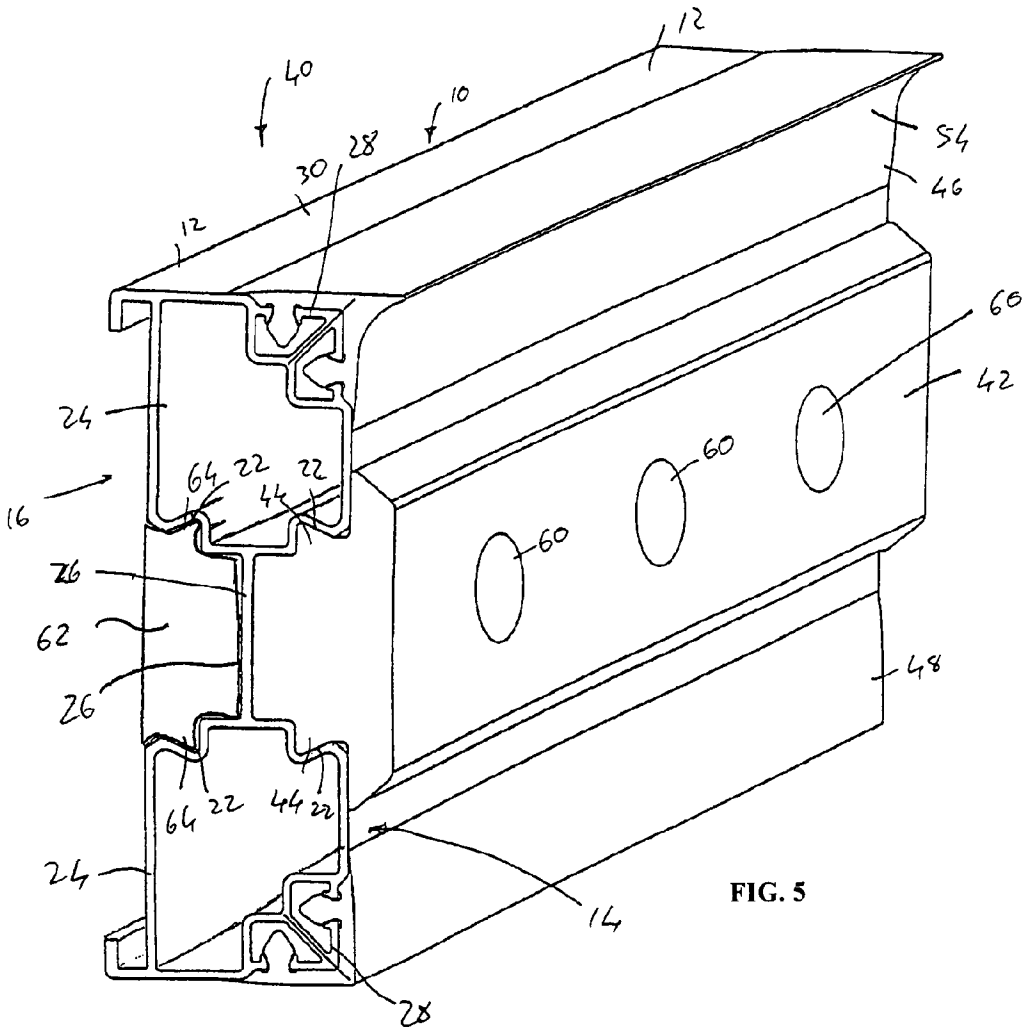
FIG. 5 shows an isometric view of a third embodiment of a sideform system.

In FIG. 5 of the drawings, yet a further embodiment of the sideform system 40 is illustrated. As in the case of the previous embodiments, like reference numerals refer to like parts, unless otherwise specified. In this embodiment, the insert 42 has a plurality of spaced apertures 60 defined through it. These apertures 60 align with the openings 32 in the web 26 of the sideform 10 to permit the passage of the constructional elements 34 through the system 40.

In addition, in the illustrated embodiment, a secondary insert 62 is provided which is received in the recessed region 20 in the rear portion 16 of the body member 12 of the sideform 10. The insert 62 is, similarly to the inserts 42, 46 and 48, also of a resiliently flexible material such as a suitable elastomeric material. The insert 62 provides structural stability to the body member 12 and has protrusions 64 received in the undercuts 22 of the recess region 20 for retention purposes.

Figure 6:
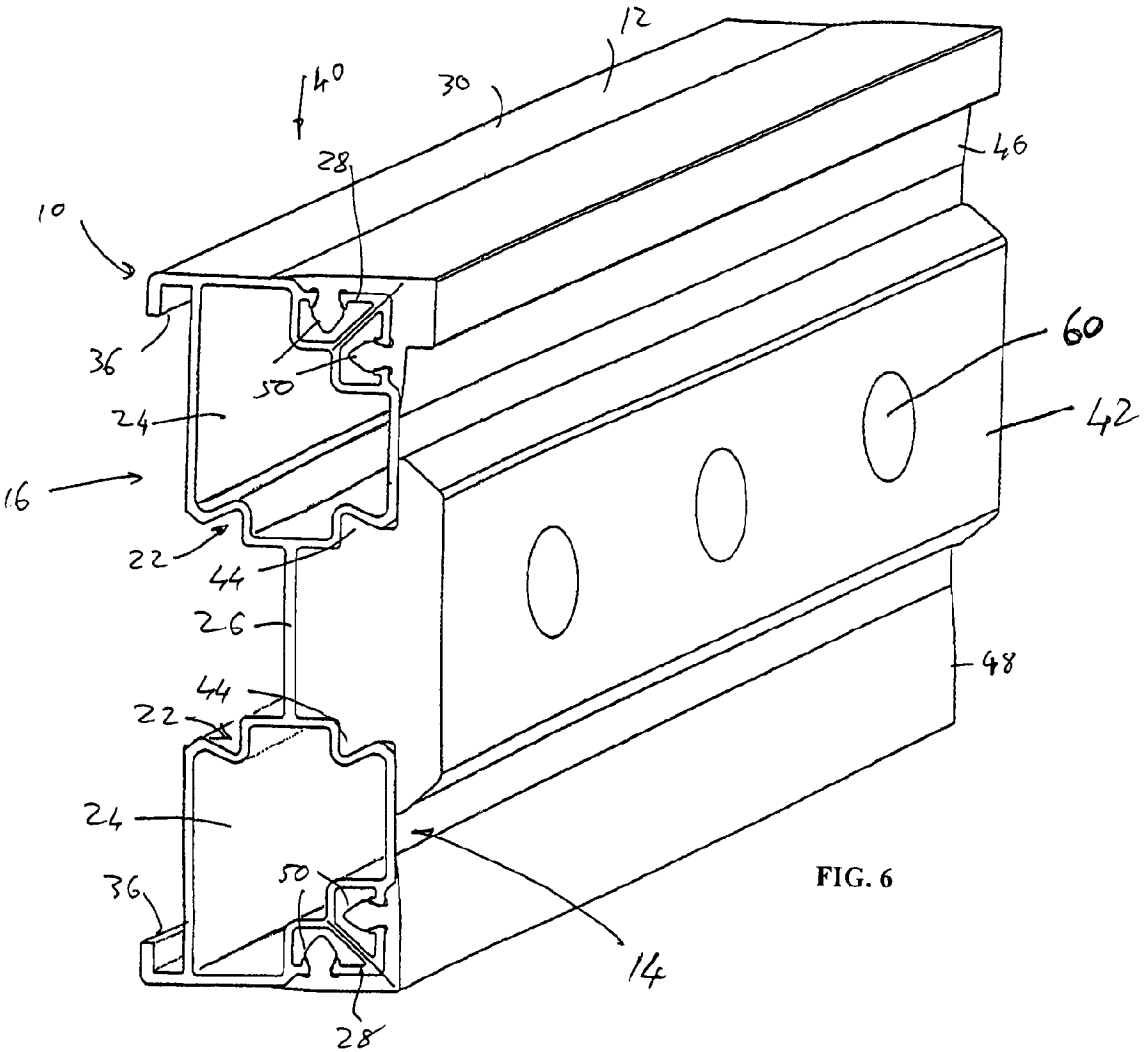
FIG. 6 shows an isometric view of a fourth embodiment of a sideform system.

In FIG. 6 of the drawings, yet a further embodiment of the sideform system 40 is shown. Once again, with reference to the previous embodiments, like reference numerals refer to like parts, unless otherwise specified. This embodiment illustrates an insert 42 with upper edge form 46 and lower edge form 48 of the embodiment shown in FIG. 3 of the drawings. In other words, the upper edge form 46 has a stepped moulding surface to impart a stepped upper perimetral edge to the concrete panel molded using that sideform 10.

Figure 7:
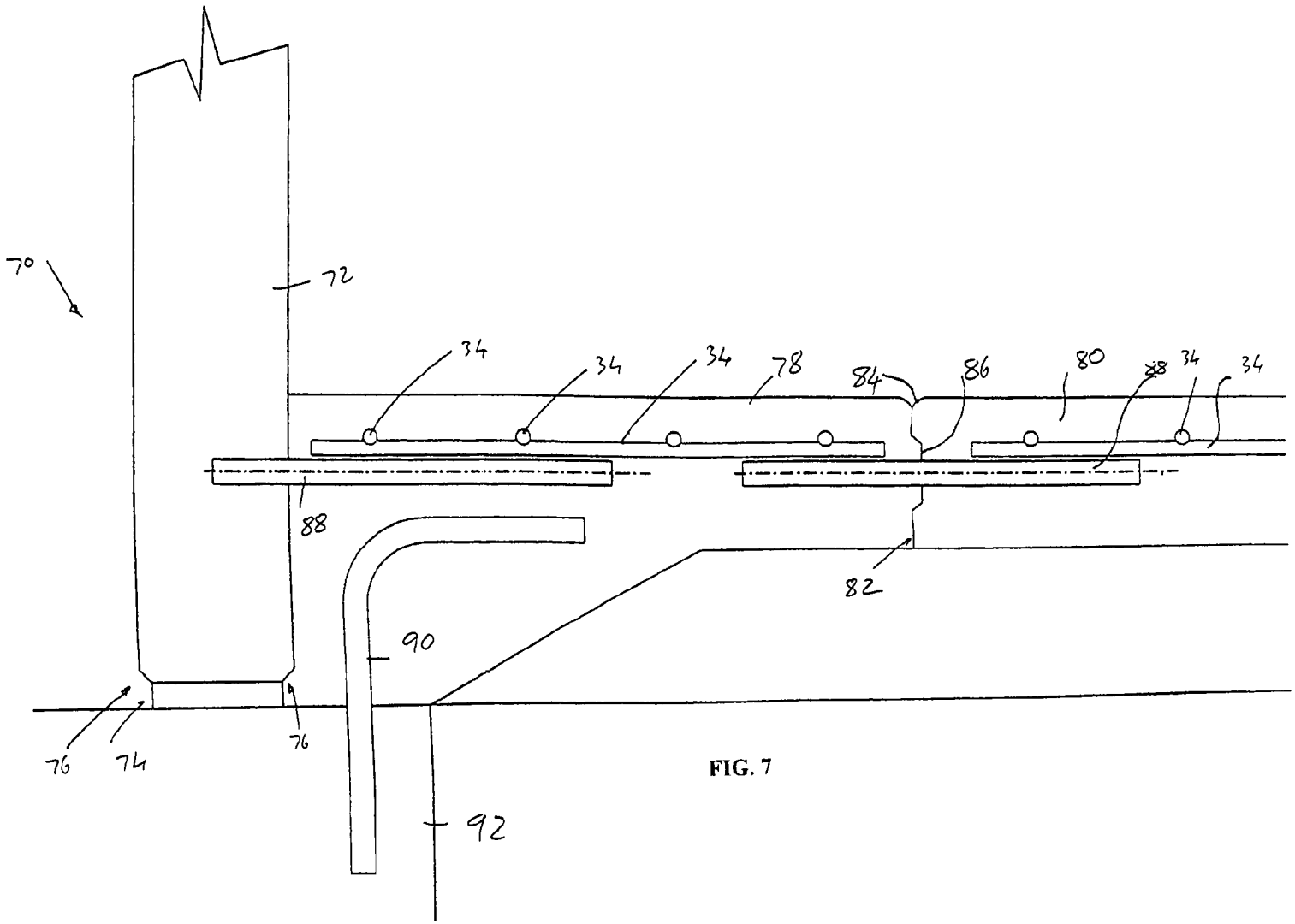
FIG. 7 shows a schematic sectional side view of a part of a building built using concrete panels cast using the sideform system.

Referring now to FIG. 7 of the drawings, a structure erected from panels/slabs cast using the sideform system 40 is illustrated and is designated generally by the reference numeral 70. A wall panel 72 has a side 74, which forms the base of the panel 72 when the panel 72 is erected, moulded using a substantially flush insert 42 received in the recessed region 18 in the side forming face 14 of the body member 12. Bevelled edge forms are used as the upper and lower edge forms 46 and 48 of the sideform system 40 to impart bevelled edges 76 to the side 74 of the panel 72.

As illustrated further in FIG. 7 of the drawings, a first floor slab 78 has the reinforcing bars 34 embedded in it. The first floor slab 78 mates with a second floor slab 80 which has its side 82 moulded using the embodiment illustrated in FIG. 5 of the drawings. Thus, the side 78 of the panel 76 has a convex, curved upper perimetral edge 84 with a bevelled recess 86 imparted to it by the insert 42. Reinforcing bars 88 interconnect the slabs 78 and 80 and the slab 78 and the panel 72. A further, cranked reinforcing bar 90 passes through the slab 78 into a foundation 92 of the structure 70.

It is an advantage of the invention that a sideform 10 is provided which lends itself to use with a number of inserts 42 and edge forms 46, 48. This provides a versatile sideform system 40 for a large number of differently shaped edges of panels or slabs to be cast. Thus, it is not necessary to maintain an inventory of a large, different number of sideforms to cast panels or slabs. The sideform system 40 is also readily reusable. If one of the inserts or edge forms should require replacement, the entire system 40 does not need to be disposed of.

It will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

The invention claimed is:

1. A sideform system, the system comprising:

an elongate body member having a pair of opposed structures interconnected by a web, the body member defining a side forming face and an opposed mounting portion for mounting the body member on a sideform holder;

at least one recessed region, defined by the web and facing portions of the opposed structures, defined in at least the side forming face of the body member;

an insert of a resiliently flexible material removably received in the recessed region;

an engaging arrangement arranged in the recessed region, the engaging arrangement engaging the insert and retaining the insert releasably in the recessed region; and at least one attaching formation arranged on the body member in association with the side forming face, the attaching formation releasably attaching a resiliently flexible edge form.

2. The sideform system of claim 1 in which each of the opposed structures of the body member is a hollow box structure, the box structures being interconnected by the web and at least one of the box structures having the at least one attaching formation.

3. The sideform system of claim 1 in which the engaging arrangement comprises an undercut part of each facing portion of the hollow structures into which complementary parts of the insert clip.

4. The sideform system of claim 1 in which the web is centrally located relative to the hollow structures to define a first recessed region in the side forming face and a second recessed region, on an opposed side of the web, in the mounting portion of the body member.

5. The sideform system of claim 4 in which at least one opening is defined in the web to permit the passage of a constructional element through the body member.

6. The sideform system of claim 2 in which each structure includes at least one attaching formations, the attaching formations being arranged on opposed sides of the recessed region in the side forming face of the body member.

7. The sideform system of claim 6 in which each attaching formation is a clip for removably mounting an edge form.

8. The sideform system of claim 1 in which the body member is an extrusion.

9. The sideform system of claim 1 which includes a plurality of inserts of different cross-sectional shapes to enable different profiles to be imparted to a side of a concrete structural element.

10. The sideform system of claim 5 in which the insert has at least one aperture defined through it, the at least one aperture being in alignment with the at least one opening in the web of the body member through which the constructional element can pass.

11. The sideform system of claim 9 in which at least one insert carries protrusions on its operatively outer surface, the protrusions, in use, being moulded into the structural element to attach the insert to the structural element to be retained on the structural element when the body member is removed, the insert then forming a sealing strip of the structural element.

12. The sideform system of claim 1 which includes at least one resiliently flexible edge form.

13. The sideform system of claim 12 which includes a plurality of edge forms of different cross-sectional shapes, each edge form being releasably attachable to the attaching formations of the body member to impart a desired edge profile to a structural element.

14. The sideform system of claim 10 in which the web of the body member has a plurality of openings defined through it and the insert has a corresponding number of apertures defined through it, the system further including a plurality of constructional elements, each constructional element being received through one of the apertures of the insert and aligned opening in the web to protrude beyond a molding face of the insert.

15. A sideform comprising an elongate body member having a pair of opposed structures interconnected by a centrally arranged web, the body member defining a side forming face on one side of the web and a mounting portion for mounting the body member on a sideform holder on an opposed side of the web;

at least one recessed region, defined by the web and facing portions of the opposed structures, defined in at least the side forming face of the body member;

an engaging arrangement arranged in the recessed region, the engaging arrangement engaging a resiliently flexible insert and retaining the insert releasably in the recessed region; and at least one attaching formation arranged on the body member in association with the side forming face, the attaching formation releasably attaching a resiliently flexible edge form.

16. The sideform of claim 15 in which at least one opening is formed through the web of the body member through which a constructional element can pass.

* * * * *